US008910334B2

(12) United States Patent
Lafleche et al.

(10) Patent No.: US 8,910,334 B2
(45) Date of Patent: Dec. 16, 2014

(54) PATIENT SUPPORT

(75) Inventors: Patrick Lafleche, Kalamazoo, MI (US); Jean-Francois Girard, Quebec (CA); Patrick Gaudreau Wong, Quebec (CA); Sylvain Lacasse, St-Romuald (CA); Sebastien Viger, L'Ancienne-Lorette (CA)

(73) Assignee: Stryker Corporation, Kalamazoo, MI (US)

( * ) Notice: Subject to any disclaimer, the term of this patent is extended or adjusted under 35 U.S.C. 154(b) by 773 days.

(21) Appl. No.: 12/640,770

(22) Filed: Dec. 17, 2009

(65) Prior Publication Data

US 2010/0146709 A1 Jun. 17, 2010

Related U.S. Application Data

(60) Provisional application No. 61/138,354, filed on Dec. 17, 2008.

(51) Int. Cl.

| | |
|---|---|
| ***A47C 27/08*** | (2006.01) |
| ***A47C 17/00*** | (2006.01) |
| ***A61G 7/057*** | (2006.01) |

(52) U.S. Cl.

CPC ..... *A61G 7/05715* (2013.01); *A61G 7/05769* (2013.01); *A61G 2007/05784* (2013.01)

USPC ..... 5/713; 5/724

(58) Field of Classification Search

CPC ..... A61G 7/05715; A61G 2007/05784; A61G 7/05769; A61G 2005/1045; A61G 5/1043

USPC ..... 5/713, 673, 654, 710–712, 724, 739, 5/740, 737–738, 722–23, 722–237

See application file for complete search history.

(56) References Cited

U.S. PATENT DOCUMENTS

| | | | |
|---|---|---|---|
| D180,063 | S | 4/1957 | Burton et al. |
| 3,192,541 | A | 7/1965 | Moore |

(Continued)

FOREIGN PATENT DOCUMENTS

| | | |
|---|---|---|
| EP | 0296689 | 12/1988 |
| EP | 0364249 | 12/1993 |

(Continued)

OTHER PUBLICATIONS

International Search Report for corresponding PCT Application No. PCT/US2009/068504.

(Continued)

*Primary Examiner* — William Kelleher
*Assistant Examiner* — Eric Kurilla
(74) *Attorney, Agent, or Firm* — Warner Norcross & Judd LLP

(57) ABSTRACT

A patient support includes a layer of fluid pressurized bladders, the bladders each having a chamber and an upwardly facing surface for facing and supporting a patient, and a cover over the layer of fluid pressurized bladders. Respective bladders in at least a group of the bladders each have a resilient body in its respective chamber to reform the shape of the respective bladder when a compression load on the respective bladder is removed wherein the pressure in the respective bladders is generally maintained without a powered supply of air. The cover has an upwardly facing patient surface and a bladder layer facing surface, with the patient surface for forming a patient support surface on the support, and the bladder layer facing surface for lying on the upwardly facing surfaces of the bladders.

20 Claims, 12 Drawing Sheets

(56) References Cited

U.S. PATENT DOCUMENTS

| | | | | |
|---|---|---|---|---|
| 3,778,851 | A | 12/1973 | Howorth | |
| 4,005,236 | A | 1/1977 | Graebe | |
| 4,279,044 | A | 7/1981 | Douglas | |
| 4,483,030 | A | 11/1984 | Flick et al. | |
| 4,541,136 | A | 9/1985 | Graebe | |
| 4,651,369 | A | 3/1987 | Guldager | |
| 4,694,515 | A | 9/1987 | Rogers, Jr. | |
| 4,698,864 | A | 10/1987 | Graebe | |
| 4,722,105 | A | 2/1988 | Douglas | |
| 4,944,060 | A | 7/1990 | Peery et al. | |
| 4,982,466 | A | 1/1991 | Higgins et al. | |
| 5,020,176 | A | 6/1991 | Dotson | |
| 5,090,074 | A | 2/1992 | Scales et al. | |
| 5,105,488 | A | 4/1992 | Hutchinson et al. | |
| 5,142,717 | A | 9/1992 | Everard et al. | |
| 5,163,196 | A | 11/1992 | Graebe et al. | |
| 5,193,237 | A * | 3/1993 | Holdredge | 5/654 |
| 5,249,319 | A | 10/1993 | Higgs | |
| 5,369,828 | A | 12/1994 | Graebe | |
| 5,379,471 | A * | 1/1995 | Holdredge | 5/655.3 |
| D355,558 | S | 2/1995 | Graebe | |
| 5,390,384 | A | 2/1995 | Dinsmoor, III et al. | |
| 5,444,881 | A | 8/1995 | Landi et al. | |
| 5,446,933 | A | 9/1995 | Gabelhouse | |
| 5,461,741 | A | 10/1995 | Graebe | |
| 5,487,196 | A | 1/1996 | Wilkinson et al. | |
| 5,493,742 | A | 2/1996 | Klearman | |
| 5,502,855 | A | 4/1996 | Graebe | |
| 5,533,220 | A | 7/1996 | Sebag et al. | |
| 5,539,942 | A | 7/1996 | Melou | |
| 5,551,107 | A | 9/1996 | Graebe | |
| 5,558,398 | A | 9/1996 | Santos | |
| 5,586,347 | A | 12/1996 | Frischknecht | |
| 5,596,781 | A | 1/1997 | Graebe | |
| 5,611,096 | A | 3/1997 | Bartlett et al. | |
| 5,613,257 | A | 3/1997 | Graebe | |
| 5,634,224 | A | 6/1997 | Gates | |
| 5,689,845 | A | 11/1997 | Sobieralski | |
| 5,699,570 | A * | 12/1997 | Wilkinson et al. | 5/713 |
| 5,797,155 | A | 8/1998 | Maier et al. | |
| 5,836,027 | A | 11/1998 | Leventhal et al. | |
| 5,870,785 | A | 2/1999 | Hoorens | |
| 5,916,664 | A | 6/1999 | Rudy | |
| 6,036,271 | A | 3/2000 | Wilkinson et al. | |
| 6,047,423 | A | 4/2000 | Larson | |
| 6,092,249 | A | 7/2000 | Kamen et al. | |
| 6,269,505 | B1 | 8/2001 | Wilkinson | |
| 6,317,912 | B1 | 11/2001 | Graebe et al. | |
| 6,321,404 | B1 | 11/2001 | Tsai | |
| 6,370,716 | B1 | 4/2002 | Wilkinson | |
| 6,510,573 | B1 | 1/2003 | Grabe | |
| 6,519,797 | B1 | 2/2003 | Brubaker et al. | |
| 6,550,085 | B2 | 4/2003 | Roux | |
| 6,564,410 | B2 | 5/2003 | Graebe et al. | |
| 6,564,411 | B2 | 5/2003 | Pirzada | |
| 6,623,080 | B2 | 9/2003 | Clapper | |
| 6,626,612 | B2 | 9/2003 | Knapp | |
| 6,684,430 | B2 | 2/2004 | Roux | |
| 6,687,936 | B2 | 2/2004 | Graebe et al. | |
| 6,687,937 | B2 * | 2/2004 | Harker | 5/726 |
| 6,691,355 | B1 | 2/2004 | Liu | |
| 6,694,556 | B2 | 2/2004 | Stolpmann | |
| 6,715,171 | B2 | 4/2004 | Grabe | |
| 6,715,174 | B2 | 4/2004 | Tsai | |
| 6,813,790 | B2 | 11/2004 | Flick et al. | |
| 6,901,617 | B2 | 6/2005 | Sprouse, II et al. | |
| 6,910,238 | B2 | 6/2005 | Biggie et al. | |
| 6,912,749 | B2 | 7/2005 | Thomas et al. | |
| 6,920,691 | B2 | 7/2005 | Ham | |
| 6,941,602 | B2 | 9/2005 | Brubaker et al. | |
| 6,986,182 | B2 | 1/2006 | Mossbeck | |
| 6,990,701 | B1 | 1/2006 | Litvak | |
| 7,107,642 | B2 | 9/2006 | Wong et al. | |
| 7,168,116 | B2 | 1/2007 | Reger et al. | |
| 7,278,179 | B2 | 10/2007 | Schneider | |
| 7,296,315 | B2 | 11/2007 | Totton et al. | |
| 7,330,127 | B2 | 2/2008 | Price et al. | |
| 7,406,734 | B2 | 8/2008 | Mai et al. | |
| 7,409,735 | B2 | 8/2008 | Kramer et al. | |
| 7,414,536 | B2 | 8/2008 | Call et al. | |
| 7,434,282 | B2 | 10/2008 | Fraser et al. | |
| 7,434,283 | B2 | 10/2008 | Wilkinson et al. | |
| 7,451,506 | B2 | 11/2008 | Kummer et al. | |
| 7,469,436 | B2 | 12/2008 | Meyer et al. | |
| 7,480,953 | B2 | 1/2009 | Romano et al. | |
| 7,513,003 | B2 | 4/2009 | Mossbeck | |
| 7,536,739 | B2 | 5/2009 | Poulos | |
| 7,557,718 | B2 | 7/2009 | Petrosenko et al. | |
| 7,565,710 | B2 | 7/2009 | Chambers et al. | |
| 7,587,776 | B2 | 9/2009 | Poulos | |
| 7,657,956 | B2 | 2/2010 | Stacy et al. | |
| 7,685,664 | B2 | 3/2010 | Stolpmann et al. | |
| 7,698,765 | B2 | 4/2010 | Bobey et al. | |
| D617,131 | S | 6/2010 | Sprouse, II | |
| 7,837,270 | B2 | 11/2010 | Eriksson et al. | |
| 7,914,611 | B2 | 3/2011 | Vrzalik et al. | |
| 7,937,789 | B2 | 5/2011 | Feher | |
| 8,397,326 | B2 | 3/2013 | Lafleche et al. | |
| 2002/0129448 | A1 | 9/2002 | Pirzada | |
| 2003/0208849 | A1 | 11/2003 | Wilkinson | |
| 2005/0050637 | A1 | 3/2005 | Graebe | |
| 2005/0097674 | A1 | 5/2005 | Mileti | |
| 2005/0125905 | A1 | 6/2005 | Wilkinson | |
| 2005/0151410 | A1 | 7/2005 | Sprouse, II | |
| 2005/0177952 | A1 | 8/2005 | Wilkinson et al. | |
| 2006/0272097 | A1 * | 12/2006 | Dionne et al. | 5/713 |
| 2007/0033738 | A1 | 2/2007 | Tu | |
| 2007/0094806 | A1 | 5/2007 | Beretta | |
| 2007/0163052 | A1 * | 7/2007 | Romano et al. | 5/713 |
| 2007/0277320 | A1 | 12/2007 | Massmann | |
| 2008/0098532 | A1 | 5/2008 | Gowda | |
| 2009/0056030 | A1 | 3/2009 | Bolden | |
| 2009/0144906 | A1 | 6/2009 | Satoh et al. | |
| 2009/0300842 | A1 | 12/2009 | Gendron | |
| 2010/0011502 | A1 | 1/2010 | Brykalski et al. | |
| 2010/0057169 | A1 | 3/2010 | King et al. | |
| 2010/0101026 | A1 | 4/2010 | Papaioannou | |
| 2010/0175196 | A1 * | 7/2010 | Lafleche et al. | 5/707 |
| 2010/0205745 | A1 | 8/2010 | Nihei et al. | |
| 2010/0205749 | A1 | 8/2010 | Huang | |
| 2010/0205750 | A1 | 8/2010 | McCausland et al. | |
| 2011/0010855 | A1 | 1/2011 | Flessate | |
| 2011/0107514 | A1 | 5/2011 | Brykalski et al. | |

FOREIGN PATENT DOCUMENTS

| | | | |
|---|---|---|---|
| EP | 0759716 | A1 | 3/1997 |
| EP | 0766525 | A1 | 4/1997 |
| EP | 1687139 | A1 | 8/2006 |
| GB | 959103 | A | 5/1964 |
| GB | 1498661 | A | 1/1978 |
| JP | 2004016547 | A | 1/2004 |
| JP | 2005137867 | | 6/2005 |
| KR | 10-0627629 | | 9/2006 |
| KR | 10-2008-0097961 | | 11/2008 |
| WO | 2007122664 | | 11/2007 |
| WO | WO 2008/073326 | | 6/2008 |
| WO | WO2010059849 | | 5/2010 |

OTHER PUBLICATIONS

Supplementary European Search Report, dated Sep. 11, 2014, for corresponding U.S. Appl. No. 12/640,770.

Supplementary European Written Opinoin, dated Sep. 11, 2014, for corresponding U.S. Appl. No. 12/640,770.

Supplementary European Search Report, dated Sep. 15, 2014, for a related U.S. Appl. No. 12/640,643.

Supplementary European Written Opinion, dated Sep. 15, 2014, for a related U.S. Appl. No. 12/640,643.

* cited by examiner

PATIENT SUPPORT

This application claims the benefit of U.S. provisional application, entitled PATIENT SUPPORT, Ser. No. 61/138,354, and filed Dec. 17, 2008, which is incorporated in its entirety by reference herein.

TECHNICAL FIELD AND BACKGROUND OF THE INVENTION

The present invention relates to a support and, more particularly, a patient support, such as a mattress that is adapted for use on a patient bed used in a hospital or other patient care facilities, including long term care facilities or the like.

When patients are hospitalized or bedridden for any significant amount of time, patients can develop pressure sores or ulcers. These pressure sores or ulcers can be exacerbated by the patient's own poor circulation, such as in the case of diabetic patients, but typically form as a result of prolonged immobility, which allows the pressure exerted on the patient's skin from the mattress to decrease circulation in the patient's tissue. Many attempts have been made to reduce the occurrence of pressure sores, ranging from simply repositioning the patient on the mattress to alternating the pressure so that the high pressure points on the patient's body are redistributed to other areas on the patient's body. Despite these efforts, pressure sores still remain a health issue.

In addition to reducing circulation in the patients' tissue, lack of mobility can also cause moisture build-up at the point of contact with the mattress. Moisture build-up can cause maceration in the skin—which makes the skin more permeable and vulnerable to irritants and stresses, such as stresses caused by pressure or by shear, for example when a patient is moved across a mattress.

Accordingly there is a need for a mattress that can reduce the pressure on a patient's skin and further that can improve air circulation to the patient's skin, all in an attempt to improve the care of a patient.

SUMMARY OF THE INVENTION

The present invention provides a patient support that provides improves immersion and envelopment of the patient into the surface of the patient support to thereby increase the contact surface area between the patient support and the patient, which reduces the pressure on the patient's body. Further, the patient support may incorporate a microclimate management system that improves air circulation at the interface between the patient and the patient support.

In one form of the invention, a patient support includes a cover and a compressible layer that includes air flow passages extending laterally and transversely through the layer. The cover envelopes the compressible layer and forms a patient support. The cover is adapted to allow moisture vapor, and optionally air, to pass through the cover and into the compressible layer at an interface between a patient and the patient support surface and also allow moisture vapor to flow out of the cover at a location other than the interface so that together the cover and compressible layer will provide enhanced air circulation and further wick away moisture from the patient's body at the interface at the patient support surface and optionally direct the moisture, and optionally air, to a location other than the interface at the patient support surface.

In one aspect, for example, the compressible layer may comprise a 3D fabric layer. Alternately or in addition, the compressible layer may comprise a gel layer. The cover may comprise a moisture vapor permeable, but liquid impermeable material, such as GORE® Medical Fabric, for example. The cover optionally may also be air permeable.

In another aspect, the patient support further includes one or more conduits for directing air flow into the compressible layer to thereby enhance the air circulation through the compressible layer.

In a further aspect, the compressible layer is supported on a foam layer. The foam layer is also compressible, but may have a lower permeability than the compressible layer. Additionally, the foam layer may then be supported on a bladder layer, with all the layers enclosed in the cover.

To further facilitate air circulation, the cover may include one or more vents that allow moisture to exhaust from the support.

In another form of the invention, a patient support includes a layer of bladders. The bladders each have an upwardly facing surface for facing and supporting the patient. The bladders may be arranged in a matrix and configured such that if a bladder is compressed by a part of the patient's body, the bladders surrounding that compressed bladder may remain at least partially uncompressed by that part of the patient's body and instead envelope that part of the patient's body to thereby distribute the weight of that part of the patient's body over a greater contact area than just the facing surface of the bladder that is compressed by that part of the patient's body. Further, each of the bladders may be in fluid communication with its surrounding bladders to allow redistribution of the pressure from the compressed bladder to its surrounding bladders.

Optionally, the compressed bladder is in fluid communication either directly or indirectly with enough of the surrounding bladders so that the surrounding bladders do not exhibit a significant increase in pressure so that they retain their unloaded stiffness or compressibility.

In yet a further aspect, the bladders may be in fluid communication either directly or indirectly with one or more pressure relief valves to allow air to escape from the bladders when the pressure in at least some of the bladders exceeds a predetermined pressure.

According to yet other aspects, a compressible, permeable layer may be supported by the bladders, which is enclosed with the bladders in a cover. The cover may comprise a moisture vapor permeable, but a generally liquid impermeable cover so that moisture vapor may pass through the cover and into the compressible permeable layer, with the compressible, permeable layer forming a reservoir for the moisture vapor passing through the cover. For example, the compressible layer may comprise a 3D fabric layer and/or a gel layer.

In another form of the invention, a patient support includes a gel layer formed from a plurality of substantially spherical gel bodies, which are arranged in an array to define an upper surface of the gel layer and a lower surface of the gel layer. Each gel body is compressible along its central vertical axis from an uncompressed state to a compressed state when a load is applied to the gel body. When the load is removed, the bodies reform to their uncompressed state. Each gel body has a gel sidewall that is interconnected with the gel sidewall of at least one adjacent gel body by a gel web, which limits lateral deflection of the gel bodies when a lateral force is applied across the gel layer.

In other aspects, the gel webs and the gel bodies define there between chambers bounded between a lower plane extending through the lower surface if the gel layer and an upper plane extending through the upper surface of the gel layer, which form low pressure areas. For example, the gel webs and gel bodies may together form the upper surface of the gel layer. Further, at least a group of the gel bodies may each have an opening at its upper surface. Additionally, at least a group of the gel bodies may each have an opening at its lower surface.

In further aspects, at least one of the gel webs between two adjacent chambers forms a fluid flow passageway at or above the lower plane to provide fluid communication between the adjacent chambers. For example, the passageway may extend through the gel web. Optionally, a group of the gel webs each form a passageway at or above the lower plane to provide fluid communication between their respective adjacent chambers.

In another form of the invention, a patient support includes a gel layer formed from a plurality of gel bodies that are arranged in an array to define an upper surface of the gel layer and a lower surface of the gel layer. The gel bodies are compressible along their respective central vertical axes from an uncompressed state to a compressed state when a load is applied to the bodies, which reform to their uncompressed state when the load is removed. Each gel body has a gel sidewall, which is interconnected with the gel sidewall of at least one adjacent gel body by a gel web, which together define there between chambers bounded between a lower plane extending through the lower surface of the gel layer and an upper plane extending through the upper surface of the gel layer. At least some of the gel webs form transverse passages there through to allow fluid to flow between their respective adjacent chambers.

In any of the above forms, at least one of the gel bodies comprises a hollow gel body. Further, each of the gel bodies may comprise a hollow gel body. In addition, each of the gel bodies may have an opening at the upper surface, and further may have an opening at the lower surface.

In any of the above forms, the gel webs and the gel bodies may be joined at their upper surfaces to thereby form a generally smooth upper surface. Alternately, the gel webs may be recessed below the upper surface.

Again in any of the above forms of the gel layer, the gel bodies may be arranged in rows, with each row of gel bodies being offset from an adjacent row of gel bodies.

Optionally, the above-described supports may also include a layer of foam for supporting the gel layer. Further, the gel layer may be coupled to the foam layer, such as by an adhesive. For example, the gel bodies and/or the gel webs may be coupled to the foam layer by the adhesive.

Alternately or in addition, the supports may incorporate a compressible layer formed from a plurality of air chambers, with the gel layer supported either directly by the air chambers or indirectly through a foam layer interposed between the gel layer and the chambers.

In another form of the invention, a patient support includes a plurality of foam blocks, with each respective block being encapsulated in fluid impermeable layers to form a chamber about the respective block. Each of the chambers is in fluid communication with an adjacent chamber and a shared inlet and a shared outlet. The shared inlet includes a check valve, which is in fluid communication with the atmosphere outside the chambers and allows fluid to flow into the chambers through the shared inlet when the pressure in the chambers is below the atmosphere outside the chambers. The shared outlet includes a pressure relief valve, which allows fluid to exit the chambers when the pressure in the chambers exceeds a predetermined pressure.

In further aspects, the impermeable layers encapsulating the foam blocks comprise one or more impervious sheets. For example, the impermeable layer encapsulating the foam blocks may comprise upper and lower impervious sheets, such as nylon sheets.

In yet further aspects, each of the chambers is in fluid communication with an adjacent chamber through channels formed by the sheets.

In other aspects, the foam blocks are arranged in rows extending laterally across the mattress and in rows extending longitudinally across the mattress wherein the foam blocks form a matrix of foam blocks. Further, each of the chambers may have a substantially planar upper surface when unloaded wherein the chambers provide a substantially continuous support surface.

According to yet another form of the invention, a patient support includes a plurality of foam blocks. Each respective block is encapsulated in upper and lower impermeable layers to form a chamber about the respective block. The chambers are in fluid communication with their respective adjacent chamber or chambers through a conduit and are in fluid communication with a shared inlet and a shared outlet. The shared inlet has a check valve, which is in fluid communication with the atmosphere outside the chambers and allows fluid to flow into the chambers through the shared inlet when the pressure in the chambers is at a predetermined minimum pressure below the atmosphere outside the chambers. The shared outlet has a pressure relief valve associated therewith and allows fluid to exit the chambers when the pressure in the chambers exceeds a predetermined maximum pressure.

In one aspect, the conduit is formed at the impermeable layers. For example, the impermeable layers may be formed by at least two sheets of impermeable material, such as a nylon, which are heat sealed together about the foam blocks. Further, the conduits may be formed between the sheets, for example, by portions of the sheets that are not heat sealed together.

In yet other aspects, the foam blocks are separate, detached foam blocks.

In yet another form of the invention, a patient support includes a plurality of separate, detached foam blocks, and at least two sheets of impermeable material encapsulating the blocks to form chambers about the blocks and form a base layer on which the blocks are supported. The chambers include a first group of chambers, with each of the chambers in the first group of chambers being in fluid communication with their respective adjacent chambers in the first group of chambers and, further, being in fluid communication with a first shared inlet and a first shared outlet. The chambers also include a second group of chambers, with each of the chambers of the second group of chambers being in fluid communication with their respective adjacent chambers in the second group of chambers and being in fluid communication with a second shared inlet and a second shared outlet. Each of the shared inlets includes a check valve associated therewith, which are in fluid communication with the atmosphere. The check valve of the first inlet allows fluid to flow into the first group of chambers from the atmosphere through the first shared inlet when the pressure in the chambers is at a predetermined minimum pressure below the atmosphere outside the first group of chambers. The check valve of the second shared inlet allows fluid to flow into the second group of chambers through the second shared inlet when the pressure in the second group of chambers is at a predetermined minimum pressure below the atmosphere outside the second group of chambers. Each of the shared outlets has a pressure relief valve associated therewith. The relief valve of the first shared outlet allows fluid to exit the first group of chambers when the pressure in the first group of chambers exceeds a predetermined maximum pressure. The relief valve of the second shared outlet allows fluid to exit the second group of chambers when the pressure in the second group of chambers exceeds a predetermined maximum pressure.

In one aspect, the patient support also includes a plurality of conduits to provide communication between the respective chambers. For example, the conduits may be provided at the base layer. Further, they may be formed between the sheets.

According to yet another form, a patient support includes a layer of fluid filled chambers, a compressible layer overlying the layer of fluid filled chambers, and a gel layer supported on the compressible layer, which forms a substantially smooth upper surface for supporting a patient and which is configured to allow air flow at least laterally or longitudinally through the gel layer.

In further aspects, the gel layer includes a plurality of hollow gel bodies. Further, the hollow gel bodies may be interconnected by a plurality of gel webs, which connect the gel bodies at the upper surface wherein the gel bodies and the gel webs form the substantially smooth upper surface.

In other aspects, each of the fluid filled chambers has a compressible body therein for reforming the shape of the chamber after a load is removed from the chamber.

In addition, the support may include a structural fabric layer, such as a 3D fabric layer, beneath the gel layer which forms a reservoir for allowing moisture vapor or moisture vapor and air to flow into the fabric layer from the gel layer.

In other aspects, each of the fluid filled chambers has a compressible body therein for reforming the shape of the chamber after a load is removed from the chamber.

According to yet other forms of the invention, a patient support includes a resilient layer, which has a patient facing side, a moisture vapor permeable and liquid impermeable layer overlying the patient facing side of the resilient layer, and a space below the moisture vapor permeable and liquid impermeable layer, which is adapted in the absence of a powered air supply to allow moisture vapor to flow across or through the resilient layer to thereby enhance the removal of moisture from a patient's body supported on the moisture vapor permeable and liquid impermeable layer.

In one aspect, when a source of liquid and/or moisture is present on the moisture vapor permeable and liquid impermeable layer, the moisture vapor transfer (MVT) into the support through the moisture vapor permeable and liquid impermeable layer is, after a first period of time, at a first MVT, with the first MVT decaying after a second prior time to a second MVT that is less than the first MVT, and then decaying to a third MVT after a third period of time which is less than the first and second MVTs, with the third MVT being greater than 20 g/(m$^2$·hr), In a further aspect, the third MVT is at least 30 g/(m$^2$·hr) and further optionally in a range of approximately 30 to 48 g/(m$^2$·hr).

In another aspect, when a source of liquid and/or moisture is present on the moisture vapor permeable and liquid impermeable layer, the moisture vapor transfer (MVT) into the support through the moisture vapor permeable and liquid impermeable layer is, after about thirty minutes, at a first MVT, with the first MVT decaying after time to a second MVT that is less than the first MVT, with the second MVT being greater than 20 g/(m$^2$·hr).

In a further aspect, the second MVT is at least 30 g/(m$^2$·hr) and further optionally in a range of approximately 30 to 48 g/(m$^2$·hr).

In yet another aspect, when a source of liquid and/or moisture is present on the moisture vapor permeable and liquid impermeable layer, the moisture vapor transfer (MVT) into the support through the moisture vapor permeable and liquid impermeable layer is initially at a first MVT, with the first MVT decaying after time to a second MVT that is less than the first MVT, with the first MVT being at least 60 g/(m$^2$·hr), and optionally in a range of 70 to 105 g/(m$^2$·hr), Accordingly, the present invention provides a patient support that reduces the pressure points on a patient lying on the support. Further, the support may be configured to increase fluid (e.g. moisture vapor or moisture vapor and air) circulation through the support to wick moisture away from the patient's skin.

These and other objects, advantages, purposes, and features of the invention will become more apparent from the study of the following description taken in conjunction with the drawings.

DETAILED DESCRIPTION OF THE PREFERRED EMBODIMENT

Figure 1:
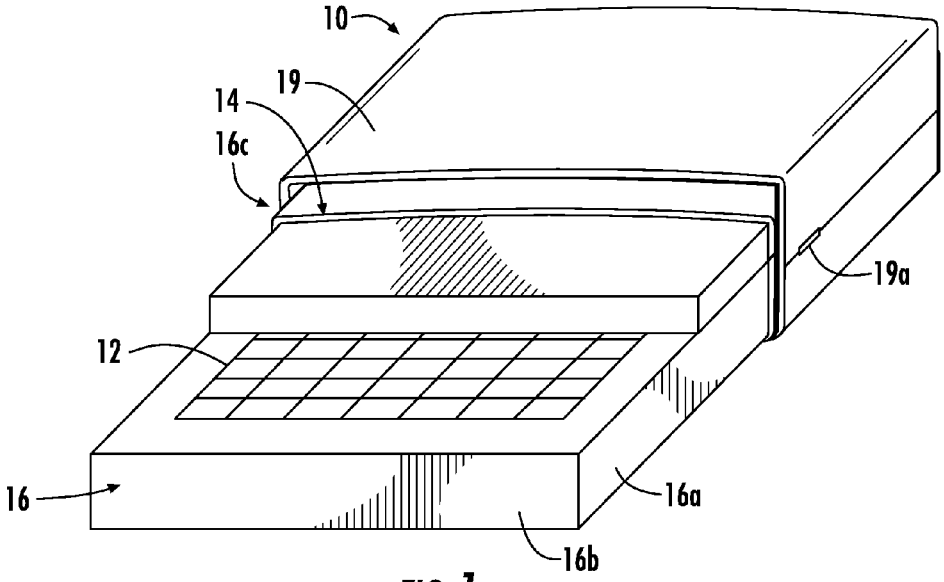
FIG. 1 is a perspective view of a patient surface of the present invention.

Referring to FIG. 1, the numeral 10 generally designates a patient support of the present invention. As will be more fully described below, support 10 may be configured as a mattress for a bed, such as a hospital bed, and comprises a system of layers that together provide increased comfort for the patient. For example, support 10 may be configured to reduce high pressure points on the patient's body when lying on the support by increasing the immersion and envelopment of the patient's body into the support's upper surface. Further, support 10 may be configured to provide increased air circulation in the support itself to thereby reduce the moisture build up at the interface between the patient and the support. As noted above, with reduced moisture build up, the patient's skin properties are less likely compromised due to maceration. Although support 10 is described as a non-powered support, the support of the present invention may also be configured as a powered support, as described in more detail below.

Figure 2:
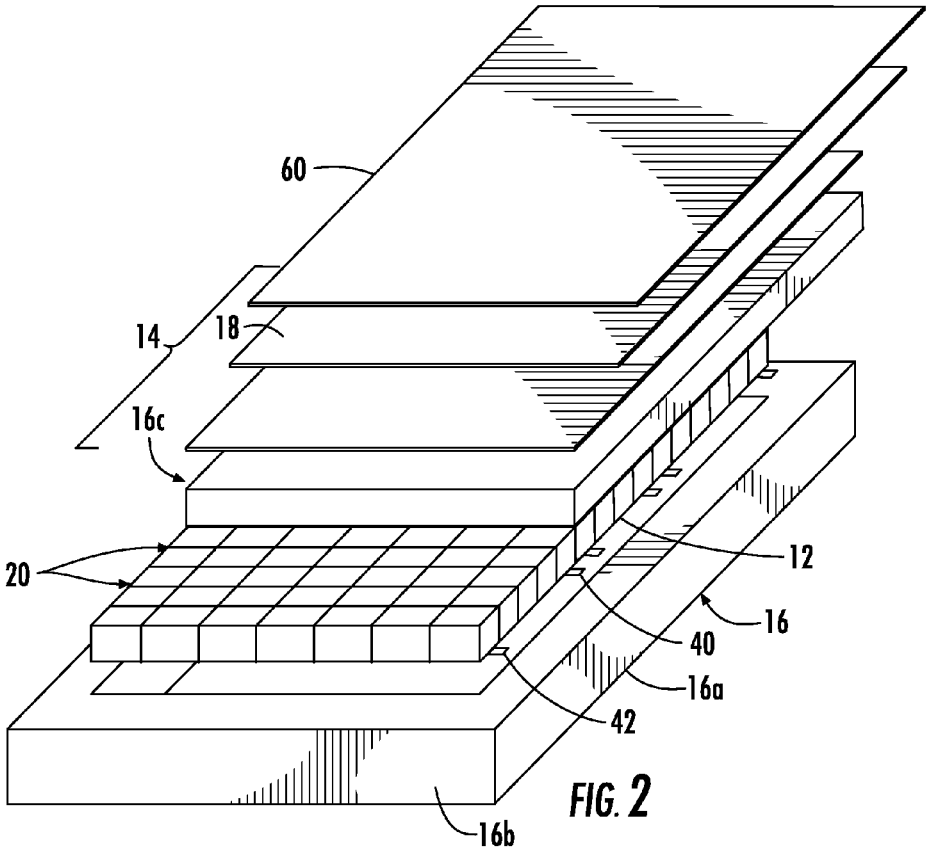
FIG. 2 is an exploded perspective view of a patient surface of FIG. 1 with the cover removed.

As best seen in FIGS. 1 and 2, in the illustrated embodiment, support 10 includes a first compressible, resilient layer in the form of a bladder layer 12 and a fluid (gas and liquid) permeable layer 14, which is supported on the bladder layer 12. As will be more fully described, below, layer 14 may also be compressible. The permeable layer is optionally supported on bladder layer 12 by a second compressible, resilient layer in the form of a foam crib 16, which may be formed from a viscoelastic foam, for example. Crib 16 includes downwardly extending sidewalls 16*a* and end walls 16*b*, and a top wall or layer 16*c*, which extends over the side walls and end walls and over the bladder layer to support the permeable layer 14. Top layer 16*c* and walls 16*a* and 16*b* enclose bladder layer 12 in the cavity formed between the sidewalls and end walls and beneath the top layer. The cavity may extend over the full length of the top wall or may extend for only a portion of the top wall, for example at the torso end of the patient support.

Top layer 16*c* may, for example, comprise a foam layer having a thickness, for example in a range of about ¼ inch to 3 inches. In addition to contribution to the overall resiliency of support, crib 16 also can provide stability to the bladder layer and, further, may be used for line management, e.g. to contain conduits, such as tubing, which may be used to direct fluid, namely air, to and from the bladders in the case of a powered version of the support. Further, the foam crib 16, which has a substantially rectangular perimeter, may provide a surface that better holds a sheet in place and further eases handling of the support as a unit. Though as described more fully below in reference to another embodiment, the upper perimeter edges or corners of the foam crib may be softened or rounded. In addition, top layer 16*c* may provide an anchor layer for layer 14. Once assembled, the crib and the permeable layer supported by the crib are then enclosed in a fire sock (not shown) and then a cover 19, which may be formed from a moisture vapor permeable, but liquid impermeable material, such as GORE® Medical Fabric, available from W. L. Gore & Associates, Inc., of Elkton, Md. Further, the cover may also be gas or air permeable.

As noted, cover 19 optionally comprises a moisture vapor permeable, but liquid impermeable cover, which may be formed from one or more sheets of moisture vapor permeable, but liquid impermeable fabric that are joined together to form a pocket in which the other layers (or layer) are enclosed. The cover may include a zipper or other attachment devices, such as hook and loop fasteners to close the cover about the layers. Cover 19 may be selected from a material or materials that allow moisture, and optionally as noted air, to permeate through cover but is adapted to prevent liquids, for example bodily fluids, from permeating the cover. However, as noted moisture in the form of vapor, for example caused from perspiration, may permeate the cover.

The moisture vapor transmission rate (MVTR) of both layer 14 and cover 19 may vary considerably. For example, it may be desirable to have a higher permeability in layer 14 than in cover 19 to assure that the moisture vapor that permeates cover 19 can be quickly distributed throughout layer 14. In one embodiment of the invention, cover 19 may have a MVTR in a range of 100 g/m$^2$/24 hours or greater, while layer 14, for example, may have a higher permeability. For example, depending on the application, suitable materials for the cover may include coated fabrics such as, for example, DARTEX fabric (Dartex Coatings, Inc., Slatersville, R.I.), having a MVTR of about 150-200 g/m$^2$/24 hours. Materials, such as Dartex, may be suitable where moisture management is less critical and pressure reduction is a primary concern. Alternatively, in an embodiment of the invention where a fabric laminate is used, for example, in applications where moisture management is of greater concern, the cover layer 19 may have a MVTR of 1000 g/m$^2$/24 hours. For example, suitable materials for the cover may comprise fabric laminates such as, for example, GORE® Medical Fabrics having a MVTR on the order of 1000 g/m$^2$/24 hours or greater, and even as high a 3000 g/m$^2$/24 hours or greater, and even as high as 6000 g/m$^2$/24 hours or greater, depending on the desire to tailor the properties of the resulting patient support. In this manner, cover 19 can help wick away moisture from the interface I between the patient's body B and the upper surface 10*a* of the support 10, and layer 14 can disperse the moisture through layer 14 to facilitate evaporation (see FIG. 14).

For the purpose of determining Moisture Vapor Transmission Rate (MVTR), the following test is carried out: The samples (measuring larger than 6.5 cm in diameter) were conditioned in a 23° C., 50%+/−2% RH test room. Test cups were prepared by placing 70 grams of a Potassium Acetate salt slurry into a 4.5 ounce polypropylene cup having an inside diameter of 6.5 cm at the mouth. The slurry was comprised of 53 grams of potassium acetate crystals and 17 g of water. The slurry was thoroughly mixed with no undissolved solids present and stored for 16 hours in a sealed container at 23° C. An expanded PTFE membrane (ePTFE), available from W. L. Gore and Associates, Inc., Elkton, Md., was heat sealed to the lip of the cup to create a taut, leakproof microporous barrier holding the salt solution in the cup. A similar ePTFE membrane was mounted taut within a 12.7 cm embroidery hoop and floated upon the surface of a water bath in the test room. Both the water bath and the test room were temperature controlled at 23° C.

Samples to be measured were laid upon the floating membrane, and a salt cup inverted and placed upon each sample. The salt cups were allowed to pre-condition for 10 minutes. Each salt cup was then weighed, inverted and placed back upon the sample. After 15 minutes, each salt cup was removed, weighed, and the moisture vapor transmission rate was calculated from the weight pickup of the cup as follows:

$$MVTR\ \text{g/(m}^2 \times 24\ \text{hours)} = \frac{\text{Weight (g) water pickup in cup}}{[\text{Area (m}^2\text{) of cup mouth} \times \text{Time (days) of test}]}.$$

The average of five tests was used.

Further, cover 19 may include one or more vents 19*a*, which are formed in, for example, the sides of the support. Vents 19*a* may be as simple as openings or may be screened openings. For example, the perimeters of the top and bottom sheets forming the cover may be left unjoined to form the opening, with a fabric screen sewn or otherwise secured over the opening. Additionally, fabric flaps may be provided to conceal the vents. In this manner the moisture can be drawn away from the patient support surface at interface I with the patient and redirected through layer 14 to a location other than at the interface between the patient and the patient support surface, for example, to the openings or vents in the cover.

As noted, layer 14 facilitates the wicking away of moisture from the interface between the patient and the support. Further, layer 14 may comprise a compressible, permeable layer, such as a spacer fabric, such a 3D fabric. For example a 3D fabric with a thickness in a range of ⅛ inch to ½ inch, including ¼ inch thick to ⅜ inch thick may be sufficient. 3D fabrics are woven in three dimensions and, as noted, may be compressible. Because of their internal structure, 3D fabrics have a plurality of interstices that allow fluid flow, especially air flow both transversely, laterally, and longitudinally through the fabric. Transversely in this context means through the thickness of the fabric. Laterally generally is used in this context to mean through the width, and longitudinally is used in this context to mean through the length of the fabric. Therefore, when layer 14 is positioned beneath cover 19, layer 14 allows the moisture vapor that permeates cover 19 to then flow transversely, laterally and/or longitudinally through layer 14. The direction of flow can vary depending on the internal structure of the spacer fabric and the temperature gradient through layer 14. Thus, layer 14 absorbs humidity and further forms a reservoir wherein the moisture vapor can be dispersed. Once air flow is established through layer 14, either by way of passing through cover 19 (if cover 19 is air permeable) or through one or more vents or openings provided in cover 19, the moisture vapor and air may be discharged from layer 14 away from the patient/support interface, for example, through other vents or openings 19*a*.

Figure 14:
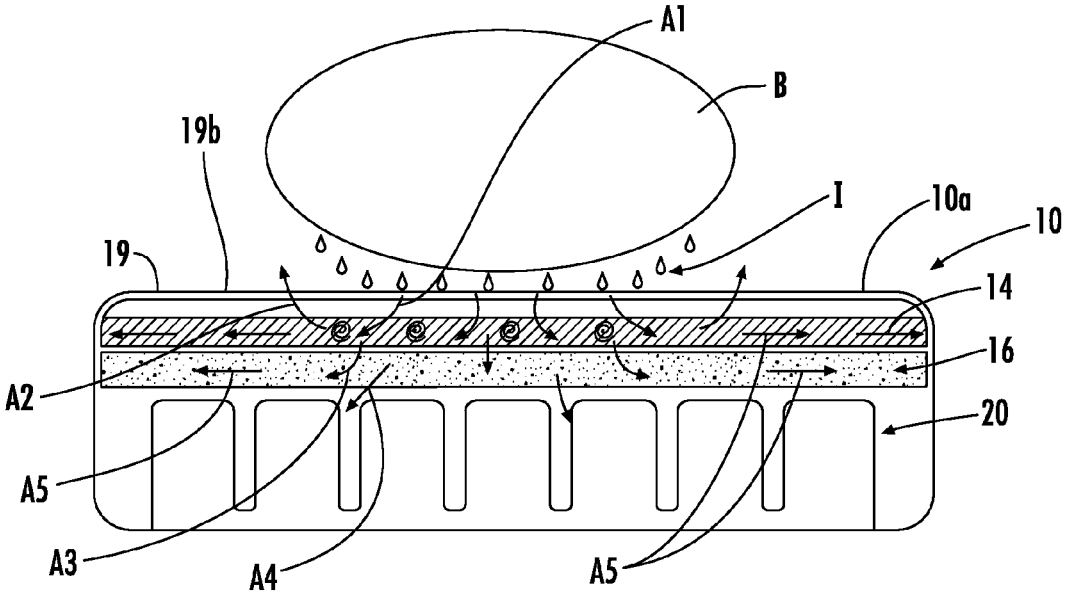
FIG. 14 is a cross-section taken through one embodiment of the patient support of the present invention.

Referring to FIG. 14, when a patient's body B is lying on support 10, the patient's perspiration and/or bodily fluids will tend to collect at the interface I between the patient's body and the upper surface or patient support surface 10*a* of support 10, which is defined as the upwardly facing surface 19*b* of cover 19 beneath the patient's body. As noted, cover 19 may be formed from a moisture vapor permeable but liquid impermeable fabric so that moisture at interface I passes through cover 19, as shown by the arrows A1 in FIG. 14, into layer 14. Given the permeable nature of layer 14, the moisture vapor can pass or flow transversely, longitudinally, and/or laterally through layer 14, and may exit support 10 through the cover (19) at a location other than interface I, as shown by arrows A2, or may pass into layer 16 as shown by arrows A3. Further, the moisture vapor may pass or flow into layer 20, for example, into the spaces between the respective bladders, as shown by arrows A4. Additionally, moisture vapor may flow to the edges of layer 14 (as well as layer 16), such as shown by arrows A5. Consequently, the one or more layers under cover 19 act as a reservoir or reservoirs and a medium to wick the moisture away from the patient's body at the interface with support surface 10*a* of support 10.

Alternately, as more fully described below, the support may incorporate an air flow system that directs air into layer 14 to circulate air through layer 14 and further facilitate the wicking away of moisture from the patient/support interface, which also facilitates the discharge of the vapor and air from the support from a location other than the patient support surface formed on the patient facing side of support 10. This system may be powered by an external air supply or may be supplied with air from the bladder layer, more fully described below.

As noted above, layer 14 may be anchored to top layer 16*c*. For example, layer 14 may be fastened to top layer 16*c* by an adhesive or other fastening methods, including hook and loop fasteners or the like. In addition, layer 14 may be extended and anchored to the side walls and/or end walls of crib 16, also by an adhesive or other fastening methods. Further, when anchored to the walls of crib 16, layer 14 may be tensioned over crib 16 so as to round off the upper perimeter edges of the crib. This may eliminate or reduce the pinch points when the support is placed on a bed frame.

Alternately, layer 14 may be placed directly on the bladder layer and further, optionally be formed by a plurality of patches or sections of fabric that are located at the upwardly facing surfaces of at least a group of the bladders, more fully described below As best seen in FIGS. 3-7, bladder layer 12 includes a plurality of bladders 20 that are arranged in rows across the mattress both in the lateral direction or axis and longitudinal direction or axis. In this manner, bladders 20 are arranged in a matrix, and with each bladder being relatively compact in size, which tends to make the control over the pressure in the surface more precise. Further, the bladders provide better immersion and envelopment of the patient's body. For example, if a patient's body is resting on a bladder (or several bladders), that bladder (or bladders) will compress and the bladders surrounding the compressed bladder (or bladders) may remain uncompressed and therefore will in effect cradle that portion of the patient's body. Further, with each bladder being independently compressible from the surrounding bladders, the compressed bladders will allow for greater immersion of the patient into the surface. The combined effect of greater immersion and increased envelopment is to increase the area of interface between the patient and the support which will improve the distribution of stress across the patient's body.

For example, the bladders are generally cube-shaped with a width or length dimension, for example, in a range of 1" to 4". Further, the thickness of the side chambers walls of the bladder may be thinner than the upper or top chamber walls of the bladders. For example, the thickness of the side walls of the bladders and the thickness of the upper chamber wall may be in a range of 0.003 to 0.025 inches. As will be more described below, each bladder 20 forms an air spring with a generally smooth and generally flat or planar upper surface. Further, the bladders are arranged in generally close proximity to each other. For example, bladders 20 may be arranged so that they have gaps in a range of 1/32 of an inch to 1/2 inch between them when assembled and in an unloaded state. It should be understood these dimensions are exemplary only and that other dimensions may be used. In this manner, bladders 20 provide a substantially continuous smooth upper support surface with only small regions of no support.

Figure 5:
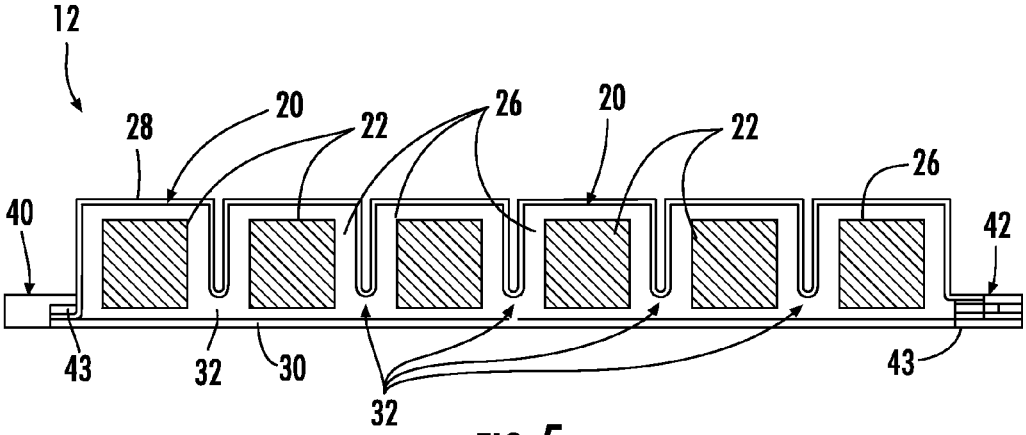
FIG. 5 is an enlarged cross-section through line V-V of FIG. 4.
Figure 6:
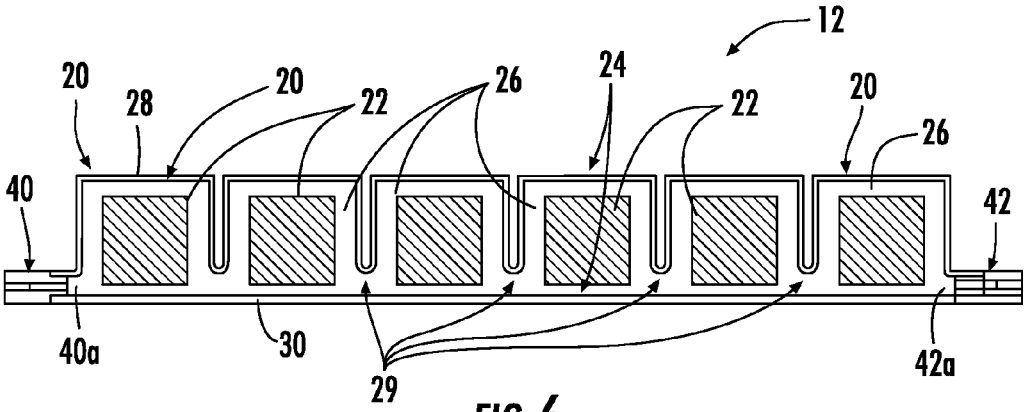
FIG. 6 is a cross-section taken through line VI-VI of FIG. 4.
Figure 7:
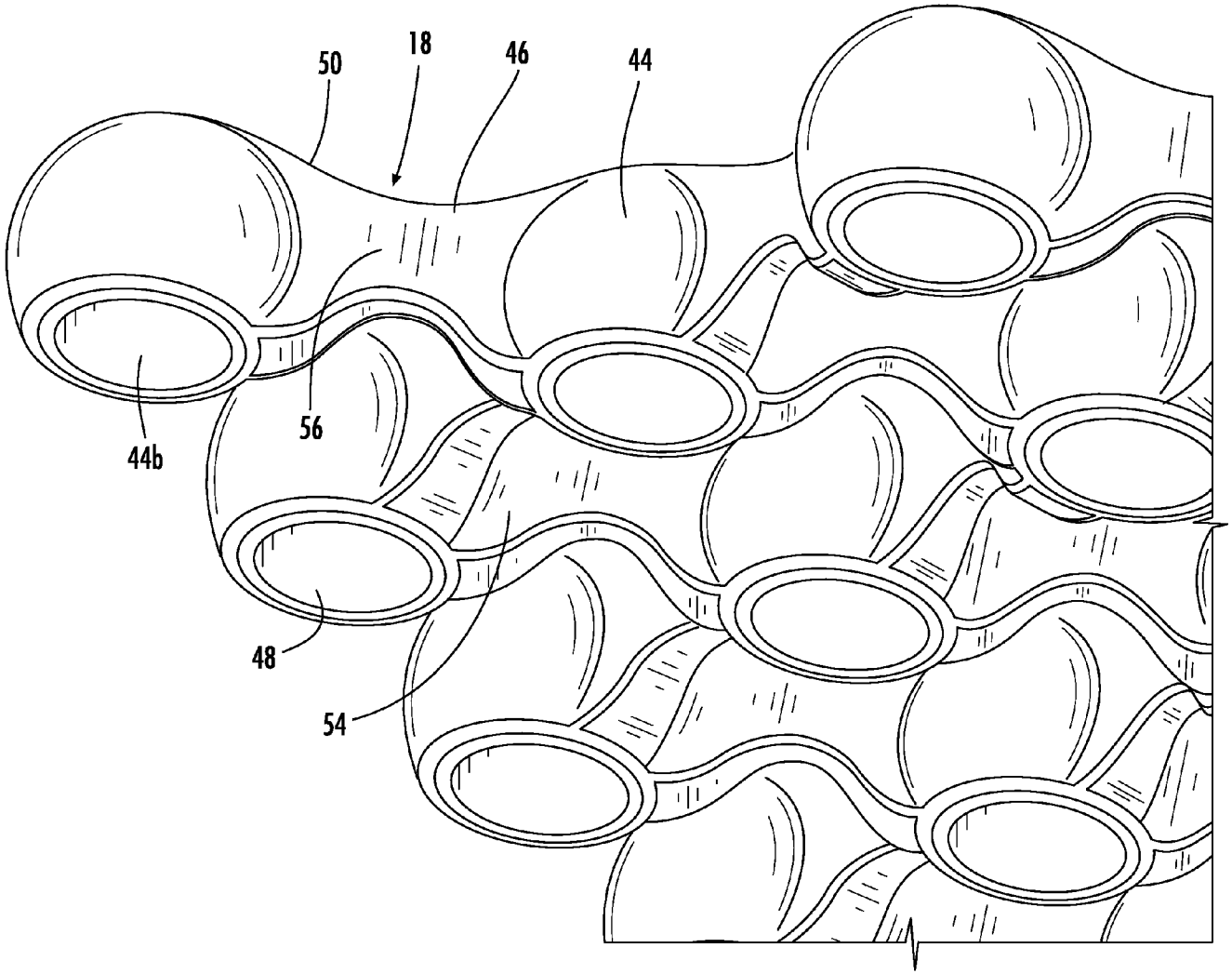
FIG. 7 is a bottom perspective of the gel layer.
Figure 8:
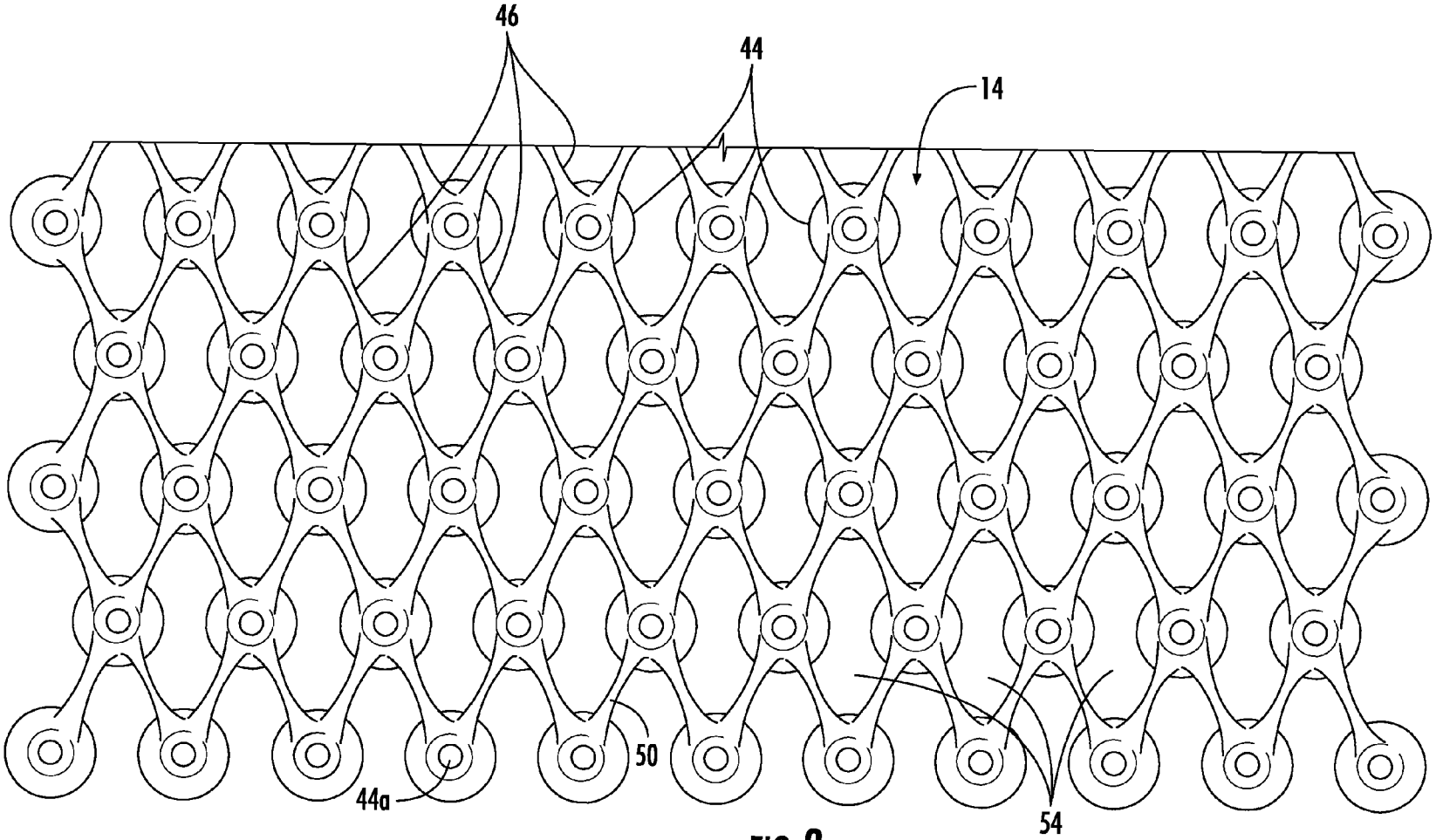
FIG. 8 is a top plan view of the gel layer.

Referring to FIG. 5, each bladder 20 is formed from a foam block 22 that is encapsulated by impervious layers 24, which form a chamber 26 around each block 22. In the illustrated embodiment, the impervious layers are formed by two impervious sheets 28, 30 that are molded around the foam blocks, for example, by thermal forming. In this manner, the lower sheet 30 forms a base layer for bladder layer 12. Though it should be understood that a single sheet may be used that is folded over to form the upper and lower impermeable layers. A suitable material for the sheet or sheets includes a flexible impermeable material, such as polyurethane or nylon. The method of forming bladder layer 12 will be described below. The patches or sections of the permeable material can then be located on the upper support surface of the bladders (at least the bladders that would be likely to be under a patient's body). The patches are optionally secured at the upper support surfaces of the bladders, for example by an adhesive.

Figure 3:
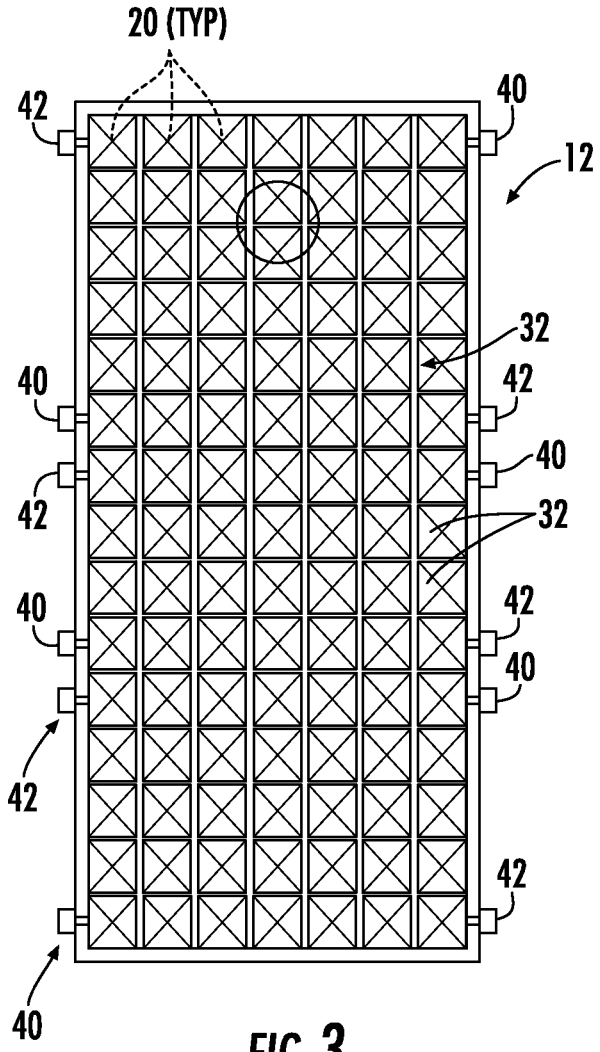
FIG. 3 is a plan view of the bladder layer of the surface.
Figure 4:
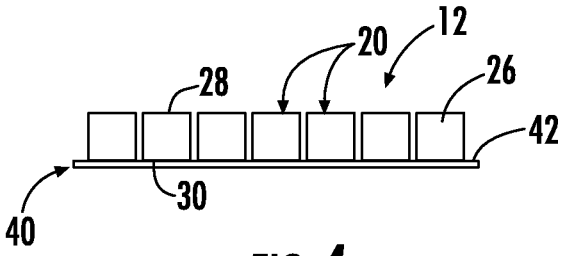
FIG. 4 is an end elevation view of the bladder layer of the surface.

In the illustrated embodiment, and as best seen in FIG. 3, each chamber 26 is in fluid communication with its adjacent chambers by a conduit 32, for example, which may be provided at the base layer. Conduits 32 may be formed from tubing or, as shown, may be formed between and by sheets 28 and 30. For example, when heat sealing the two sheets together around the foam blocks, the mold that heat seals the two sheets together may have relief areas so that selected regions of the sheets are not welded together, which unsealed regions form the passageways. Alternately, tubes may be placed between the sheets or a release material may be applied to one or more of the facing sides of the sheets at discrete portions that extend between the chambers, which prevents the two sheets from being joined together and from forming seals (29, see e.g. FIG. 6) where the release material is applied. In this manner, passageways can be created between the adjacent chambers to allow air flow between the chambers.

Consequently, each bladder is independently compressible from its surrounding bladders and further when compressed does not significantly impact the pressure in the adjacent chambers since any redistribution of air is redistributed to all the bladders surrounding the compressed bladder, which surrounding bladders in turn redistribute any increase in pressure to their respective surrounding bladders. Consequently, as noted above, when pressure is applied to one bladder, the surrounding bladders will remain substantially in their static or unloaded configuration and hence will cradle that portion of the patient's body that is immersed into the compressed bladder. Further, because the pressure in the surrounding bladders is not significantly increased, they substantially retain their same compressibility and stiffness and do not inhibit movement of the patient even though the patient may be fairly deeply immersed into the surface.

In this embodiment, flow of air into and out of layer 12 is controlled by one or more inlet check valves 40 and one or more outlet pressure relief valves 42, which are mounted for example at the outer seam formed at the perimeter of layer 12 and are each in fluid communication with the atmosphere outside the chambers. The check valve (or valves) allow air to flow into the chambers when the pressure inside the bladders falls below a predetermined minimum pressure value below the atmosphere (which selected as the set pressure of the check valve). The pressure relieve valve (or valves) open to allow air to flow from the chambers when the pressure in the chambers exceeds a preselected maximum pressure value (which is selected as the release pressure for the valve) and thereby vent to the atmosphere.

In the illustrated embodiment, layer 12 includes three groups of chambers. One group of chambers, for example, may be provided at the foot end of the layer, another group at the torso region, and the other group may be provided at the head end of the layer. Each group of chambers is isolated from the other group, but with each chamber in each group in fluid communication with its adjacent chambers. Therefore, in order to provide air flow to each group of chambers, layer 12 may include one or more check valves 40 and one or more pressure relief valves 42 for each group of chambers. When forming the three groups of bladder from two sheets, the three groups may be formed in a similar manner to a single group of chambers except the passageways between the adjacent chambers in the different groups are not formed. In other words, only the chambers in the same group will have passageways formed between their adjacent chambers. Alternately, each group of bladders may be made separately and then optionally coupled to the adjacent group of bladders.

In another embodiment of the bladder layer, one or more bladders in each group of bladders may be isolated from the other bladders and, therefore, may include their own inlet and outlet valves. Alternately, one or more bladders may be sealed.

In the illustrated embodiment, two inlet check valves and two pressure relief valves are associated with each group of chambers. Further, the valves may be mounted at ports 40*a* and 42*a* formed between the two sheets 28 and 30, for example, as noted at the sides of bladder layer in the seam formed by perimeter flanges 43, which are formed around the perimeter of layer 12 when the two sheets are thermal formed together. It should be understood that the valves may be in fluid communication with the ports via a conduit, such as tubing. However, with the present design, tubing for inflating the bladders can be entirely eliminated, at least for a non-powered surface. It should be understood that tubing may still be needed for other purposes, for example, a low air loss system. Even then, as more fully described below, the low air loss system may be supplied by the bladders themselves.

The foam forming foam blocks 20 may be formed from a single sheet of foam, for example, a foam sheet having a thickness in a range of 1 inch to 4 inches. Suitable foams include foams having a LDI in a range of 15 to 90 or in a range of 30 to 50. The foam sheet is then cut into the foam blocks by a cutter. The foam blocks are then positioned between two sheets (or two folded portions of one sheet) of flexible impermeable material, such as polyurethane or nylon. Then using a mold and heat (thermoforming), the upper sheet conforms to the foam blocks and is welded to the lower sheet between each block to thereby encapsulate the foam blocks between the two sheets. Further, as noted above, the mold may have reliefs formed in the molding surface where a seal or weld is not desired, such as to form the passageways (to allow the chambers to have fluid communication) or at the ports.

Bladder layer 12 may also be formed by dipping foam blocks in molten rubber or the rubber may be sprayed onto the foam blocks. Alternately, the bladder layer may be formed from an injection molding process. For example, the material forming the impermeable outer layer may be injected into a mold cavity to form the side of the bladder layer with the chambers. After cooling, the foam blocks may then be placed into the respective cavities and thereafter enclosed by the second sheet of the impermeable outer layer placed over the blocks to thereafter welded or glued to the first layer. Alternately, the material forming the impermeable outer layer may be injected into a mold cavity around the foam blocks.

Referring again to FIG. 1, layer 14 may be substituted for or supplemented with a third compressible, resilient layer, namely a gel layer 18. Gel layer 18 may be placed on layer 14 and may be anchored to layer 14 and also enclosed with crib 16, layer 14 and bladder layer 12 in cover 19. Where gel layer 18 is provided in lieu of layer 14, then gel layer 18 may be anchored directly to top layer 16*c* or may be placed directly on bladder layer 12. Further, as more fully described below, gel layer 18 may also be adapted to allow moisture vapor and optionally air to flow transversely, laterally, and/or longitudinally through gel layer 18. Therefore, in addition to forming a resilient layer, gel layer 18 may also form a permeable layer to facilitate the wicking away of moisture from the interface between a patient's body and the patient support surface Referring to FIGS. 7-10, gel layer 18 includes a plurality of gel bodies 44. Gel bodies 44 are generally spherical in shape and further optionally hollow so that they provide a low stiffness or soft spring for resiliently supporting the patient's body. However, in order to eliminate the noticeable point contact that is associated with some prior art surfaces, such as disclosed in PCT WO 2007/128113, gel bodies 44 are interconnected by a plurality of gel webs 46, which connect the respective sidewalls 48 of adjacent gel bodies 44 at the upper surface of layer 18 to thereby form the upper surface of the gel layer along with the gel bodies. Gel webs 46 have a wall thickness that may be greater than the wall thickness of the sidewalls of the gel bodies so that they provide similar spring stiffness to the gel bodies.

Further, the gel webs each have an upper facing surface 50 that is generally continuous with the upper surface 52 of each gel body 44 so that together the gel bodies and gel webs form a substantially smooth upper surface, which reduces, if not eliminates, the feeling of being supported on discrete points. In addition, by extending the connection between the gel webs and the respective gel bodies over substantially the full height of the gel bodies, the gel webs stiffen the gel body walls. Further, this construction limits the lateral movement of the individual gel bodies by tying them together in a grid.

By limiting the lateral movement of the gel bodies, the drag on a cover, which is placed over the gel layer, is reduced, which may reduce the shear on a patient's skin.

Referring again to FIG. 6, gel bodies 44 are generally equally spaced from each other and together with gel webs 46 form cavities or chambers between them that are bounded by a generally horizontal plane that extends through the upper surface of bladder layer 12 and the generally horizontal plane that extends through the lower surface of bladder layer 12, which is closed by compressible layer 18. Similarly, the upper plane is closed by the cover noted above. Hence, gel layer 14 includes a plurality of pockets or chambers 54 defined between the cover and layer 18 and between gel webs 46 and gel bodies 44, which may be used as part of a fluid circulation system, described below. Further, these chambers form areas of low pressure, while bodies 44 form areas of higher pressure.

As noted above, gel bodies 44 may comprise hollow gel bodies. In order to allow air to escape from the chambers formed in the hollow gel bodies, each gel body may include an upper opening 44*a* so that when a load is applied to the gel bodies, air will flow out of the gel body. The downwardly facing side of each gel body also includes an opening 44*b*, which may be covered by layer 14, as noted below. The size of the upper opening may be adjusted to control to some degree how quickly the gel body will compress when a load is applied.

Figure 9:
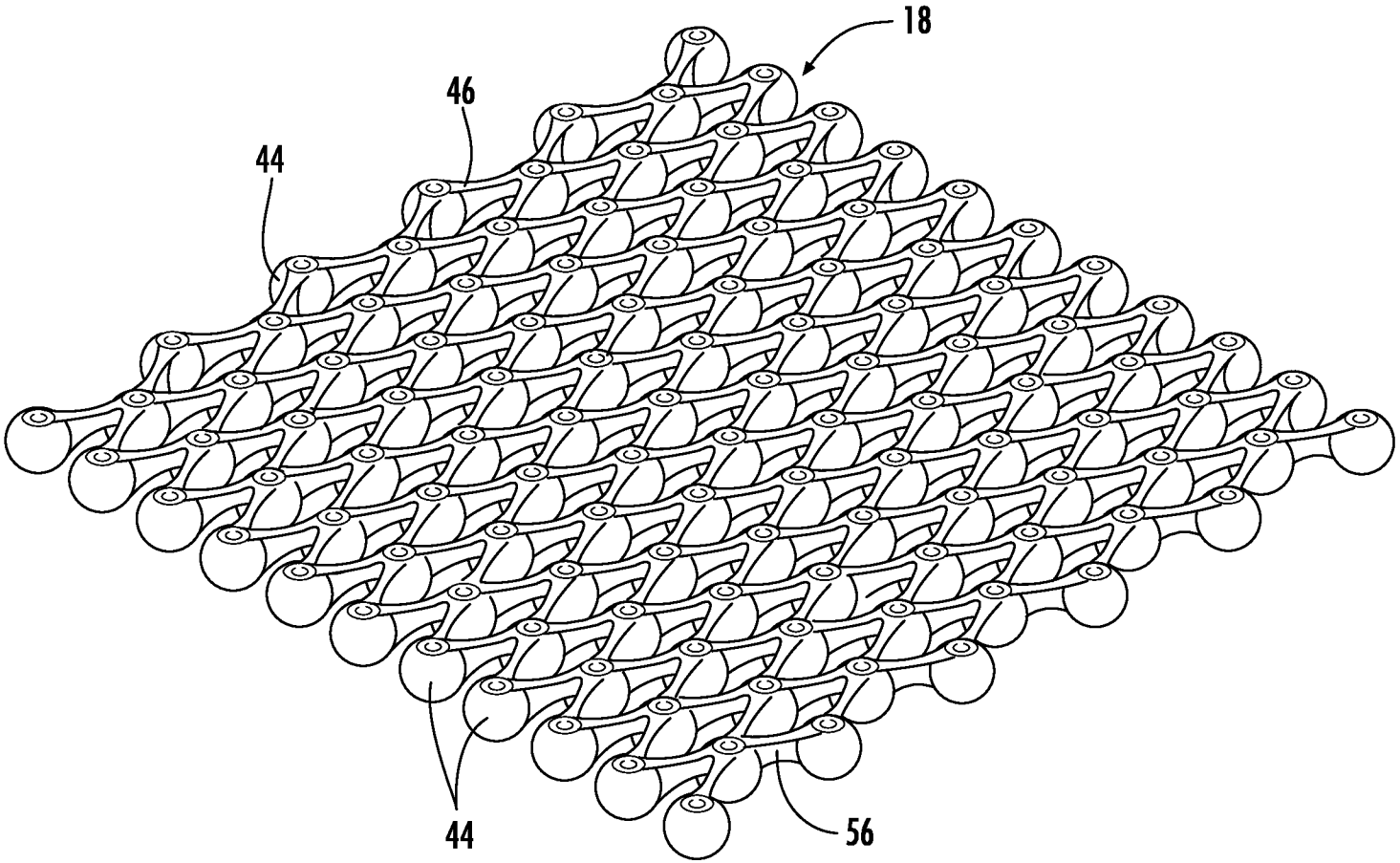
FIG. 9 is a top perspective view of the gel layer.
Figure 10:
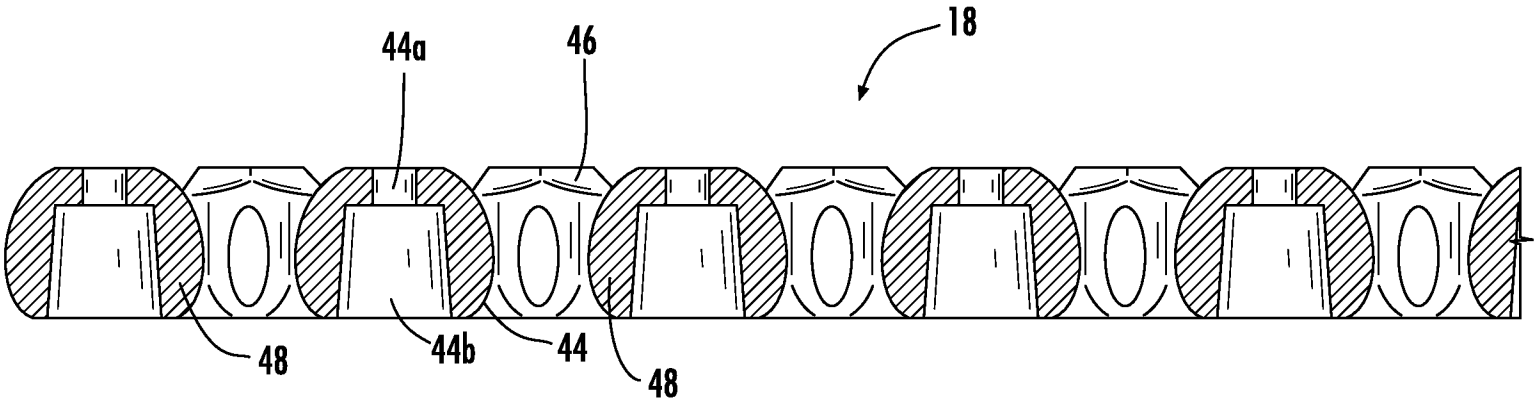
FIG. 10 is a cross-section view taken along line X-X of FIG. 7.

As noted, chambers 54 formed between gel bodies 44 and gel webs 46 may be part of a fluid movement system to increase circulation through the support similar to the 3D fabric layer referenced above. Further, as noted, it may replace the 3D fabric layer or the thickness of the 3D fabric may be reduced. In the illustrated embodiment, fluid communication between the chambers 54 may be provided by forming passageways through or below gel webs 46, which allow fluid to flow laterally and longitudinally through the gel layer. As best seen in FIG. 9, each gel web 46 includes a recessed portion 56 at its lower edge at their juncture with layer 14, which forms fluid passageways between the adjacent chambers. This recess may be provided by forming an opening in the respective webs or may be formed when molding the webs, with the latter most likely providing the most efficient method of forming the fluid passageways. In this manner, each of the chambers may be in fluid communication with each other. Consequently, air can flow laterally and longitudinally through gel layer, and also transversely, which allows moisture to be wicked away from the patient's skin.

As noted above, gel layer 18 may be secured to layer 14. For example, gel layer 18 may be secured to layer 14 by an adhesive. When joining gel layer 18 to layer 14, the adhesive may be applied between the gel webs as well as the perimeter of openings 44*b* so that both the webs and gel bodies are anchored to layer 14.

In order to further enhance fluid (moisture vapor and/or moisture vapor and air) circulation through surface 10, surface 10 may include another permeable layer 60 on top of gel layer 18, which is moisture vapor permeable, or air and moisture vapor permeable or which is permeable to all fluids. For example, a suitable moisture vapor permeable layer may be formed from GORE® Medical Fabric. Alternately, a permeable layer may include a spacer fabric, such as a 3-D fabric. With the 3-D fabric, as noted, the porosity of the material not only provides permeability transversely through the thickness of the layer but also laterally and longitudinally through the layer.

In addition, support 10 may include a low air loss system or air circulation system. For example, separate perforated conduits, such as perforated tubing, may be mounted between the bladders and, further, may be positioned between selected chambers so that the conduits run across the width or length (or both) of layer 12 at discrete locations below top layer 16*c*. The tubes or tubing may then direct air into layer 14. For example, top layer 16*c* may incorporate one or more openings to allow the ends of one or more tubes to be positioned to direct air to flow into layer 14.

These tubes or tubing is then coupled to a supply of air, for example an air blower or pump, which is then regulated by a conventional control. Further, the pump and any supporting control system may be mounted in the support itself, such as described in U.S. Pat. Nos. 5,325,551, and 5,542,136, both commonly owned by Stryker Corporation of Kalamazoo, Mich.

Alternately or in addition, bladder layer 12 may be adapted to form the low air loss system or air circulation system. In one form, air flow to bladder layer 12 may be controlled by a powered system that includes a blower or pump that is in fluid communication with one or more of groups of chambers, for example by tubing, to supply air flow to the chambers. Perforations then may be formed or otherwise provided in the upwardly facing side of chambers, which allow air to flow upwardly to thereby form a low-air loss system or air circulation system. In this manner, the upper surfaces of the bladders are at least permeable to the flow of air. Alternately, the top sheet forming the bladders may be formed from a gas permeable material but with a transfer rate that permits air to inflate the respective bladders and maintain inflation of the bladders but which permits sufficient air to flow from the top surface of the bladders to help wick away moisture.

In yet another embodiment, the self-adjusting bladders may be coupled to one or more tubes or tubing, which may be coupled to the bladders through the pressure relief valves. In this manner, rather than exhausting the excess air from the bladders at the side of the bladder layer when the pressure in the bladder layer exceeds a desired pressure value, the exhaust air may be redirected to layer 14 for climate control purposes. In this manner, the patient's movement may power the air circulation or low air loss system.

In any of these applications, as noted, layer 14 preferably comprises a permeable layer so that air flowing from the bladder layer or tubes will pass through layer 14 so that the flowing air will facilitate the wicking away of moisture from the patient's skin.

Further, while described above as having foam blocks in each bladder, when the present invention is used as a powered system, e.g. when used in combination with a pump or blower and a control system, then the foam in one or more of the bladders may be eliminated.

Figure 11:
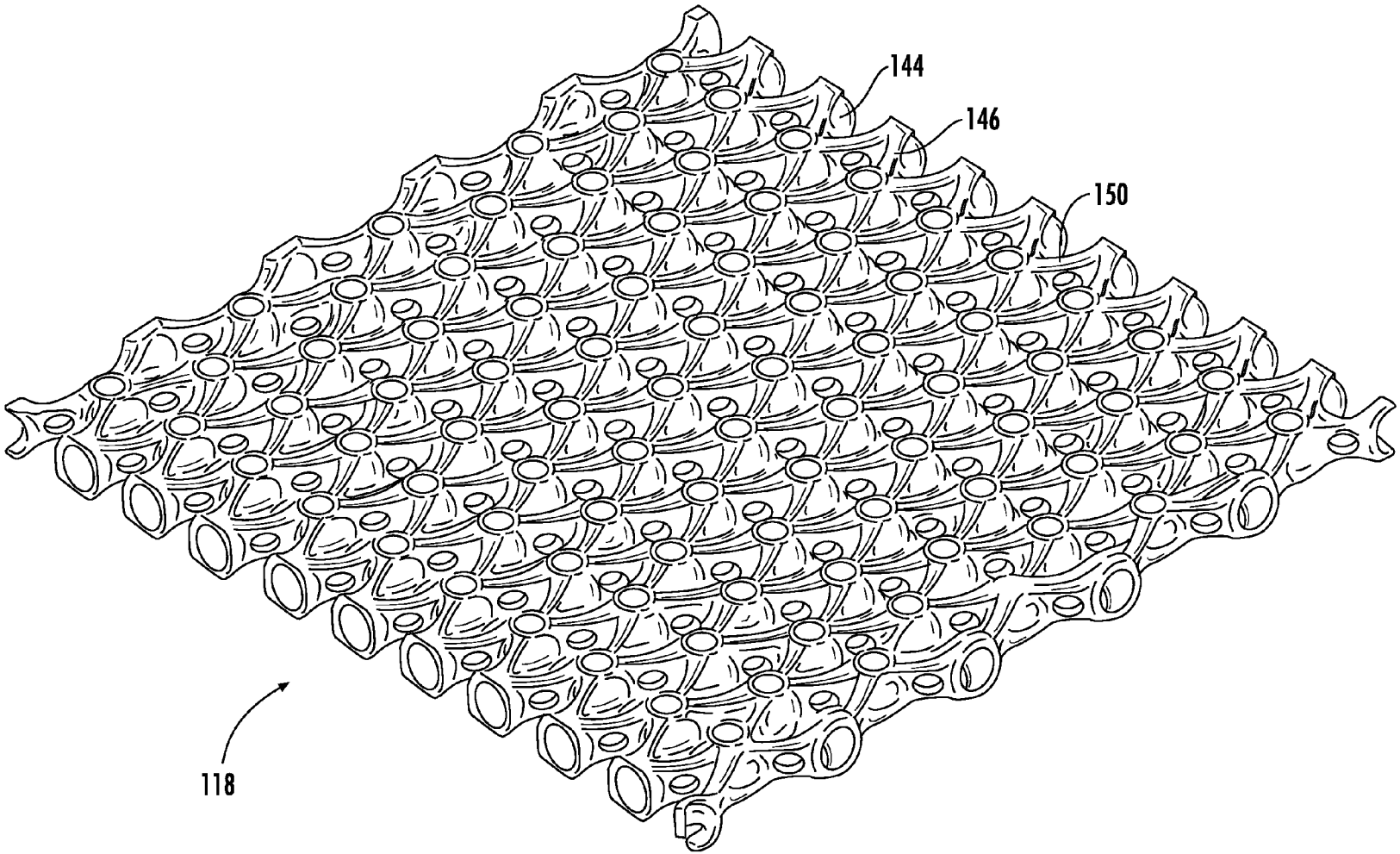
FIG. 11 is a perspective view of another embodiment of the gel layer of the present invention.
Figure 12:
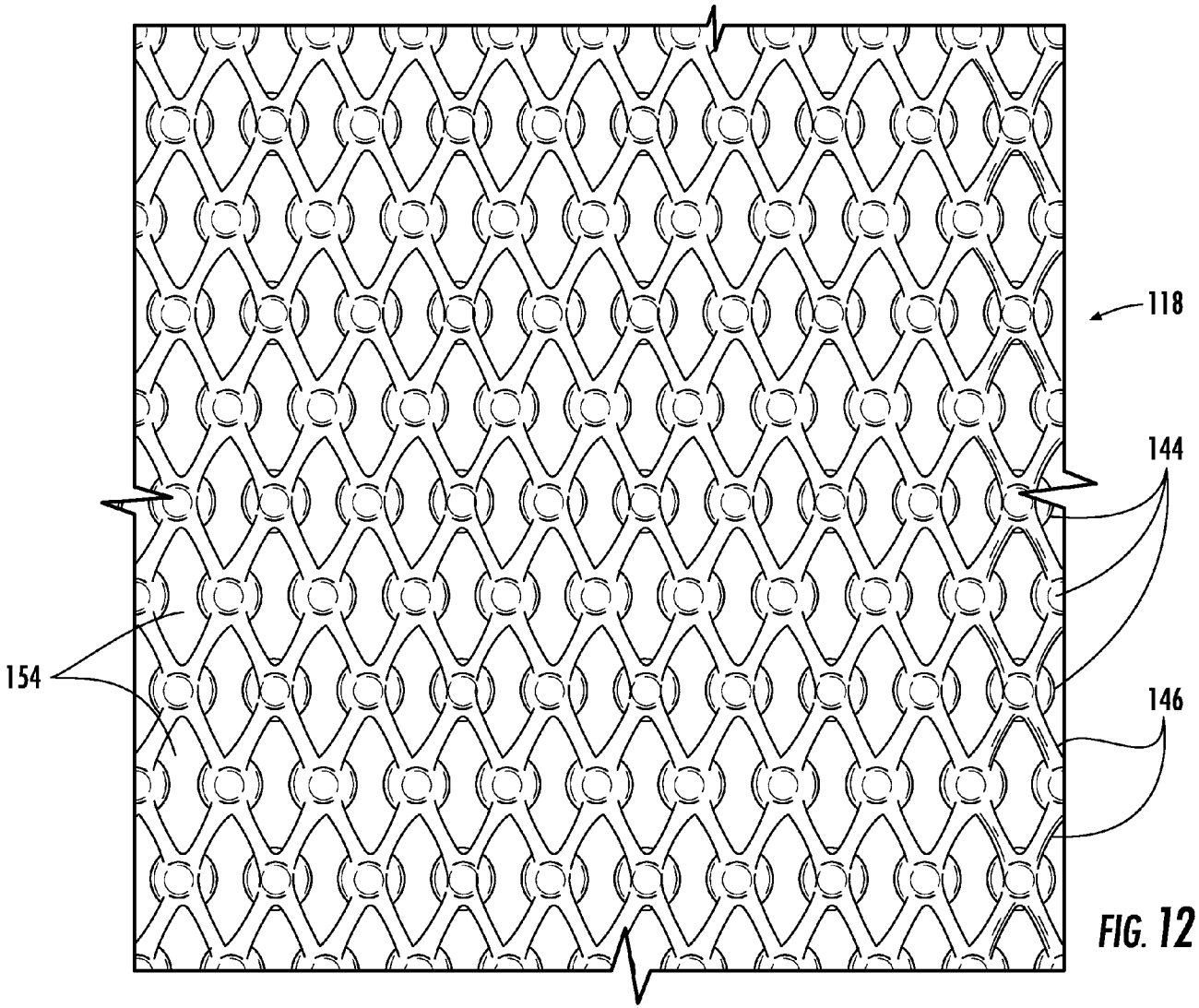
FIG. 12 is a plan view of the gel layer of FIG. 11.
Figure 13:
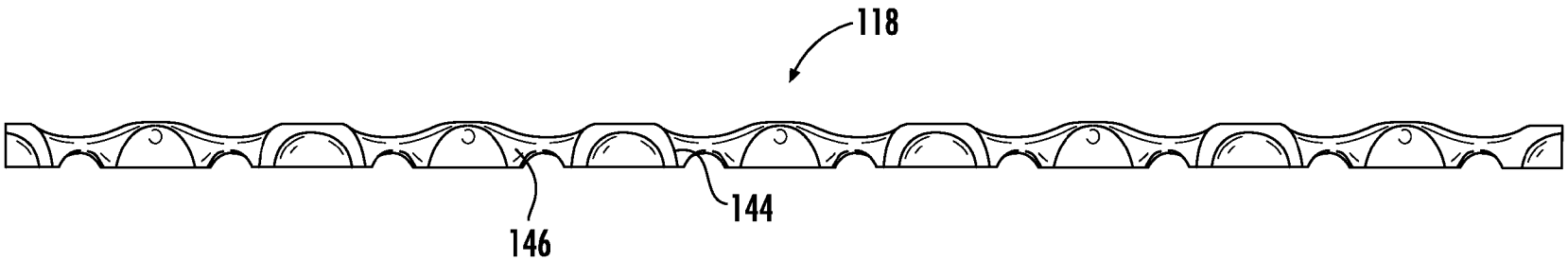
FIG. 13 is a cross-section view of the gel layer of FIG. 13.

Referring to FIGS. 11-13, the numeral 118 refers of another embodiment of the gel layer of the present invention. Gel layer 118 similar to gel layer 18 includes a plurality of gel bodies 144. Gel bodies 144 are generally semi-spherical in shape and also optionally hollow so that they provide a low stiffness or soft spring for supporting the patient's body. Gel bodies 144 are also interconnected by a plurality of gel webs 146, which connect the respective sidewalls 148 of adjacent gel bodies 144 at the upper surface of layer 118 to thereby form the upper surface of the gel layer along with the gel bodies. Gel webs 146 have a wall thickness that may be greater than or generally equal to the wall thickness of the sidewalls of the gel bodies so that they provide a similar spring stiffness to the gel bodies.

Similar to layer 18, layer 118 includes a plurality of chambers or cavities between the gel bodies and the gel webs that are in fluid communication with each other to provide lateral and longitudinal air flow through layer 118.

In the illustrated embodiment, layer 118 is formed from two gel layers, each formed as shown in FIG. 13, but which are then oriented so that the open ends of the semi-spherical bodies are facing each other to thereby form spherical gel bodies. The layers are joined at their respective facing surfaces, for example by an adhesive. For further details of layer 118, reference is made to layer 18.

In either embodiment, the gel bodies have a height that is less than or equal to the width of the gel body. In this manner, the gel bodies will not buckle and instead will compress along their central vertical axes.

As mentioned, the surface of the present invention may also be a powered surface. In which case, rather than having the check and pressure relief valves open to the atmosphere the valves may be coupled to a system of tubes or tubing that is coupled to an air pump or blower that is controlled by a control system as simple as an on-off switch or a control system that includes a controller that provides more advanced control functions and optional feedback controls. Further, the valves may be provided in the form of one or more manifolds, which then are controlled to control the flow of fluid to and/or away from the surface. Thus in a powered application, the foam in the bladders may be eliminated.

Accordingly, as would be understood, the patient support may be formed from one or more resilient layers (e.g. a gel layer, a bladder layer, and/or a foam layer (crib)) and one or more permeable layers (e.g. spacer fabric or 3D layer and or gel layer) and one or more moisture vapor permeable, but liquid impermeable layers (such as a layer formed from GORE® Medical Fabric). Further, where the resilient layer can provide an adequate space to form a reservoir or reservoirs, the separate permeable layer may also be eliminated so that the patient support may include the resilient layer and the one or more moisture vapor permeable, but liquid impermeable layers (such as a layer or layers formed from GORE® Medical Fabrics). As described, the layers work as a system to provide resilient support to a patient, optionally with the improved immersion described herein, and further to wick away moisture form the interface between a patient's body and the patient support. This is achieved at least in part by providing a space under the upper moisture vapor permeable, but liquid impermeable layer that can act as a reservoir for the moisture vapor that passes through the upper layer so that the moisture can be drawn away from the patient's body and redirected to another location, such as a location outside the support, all while protecting the resilient layers from liquid intrusion.

Figure 15:
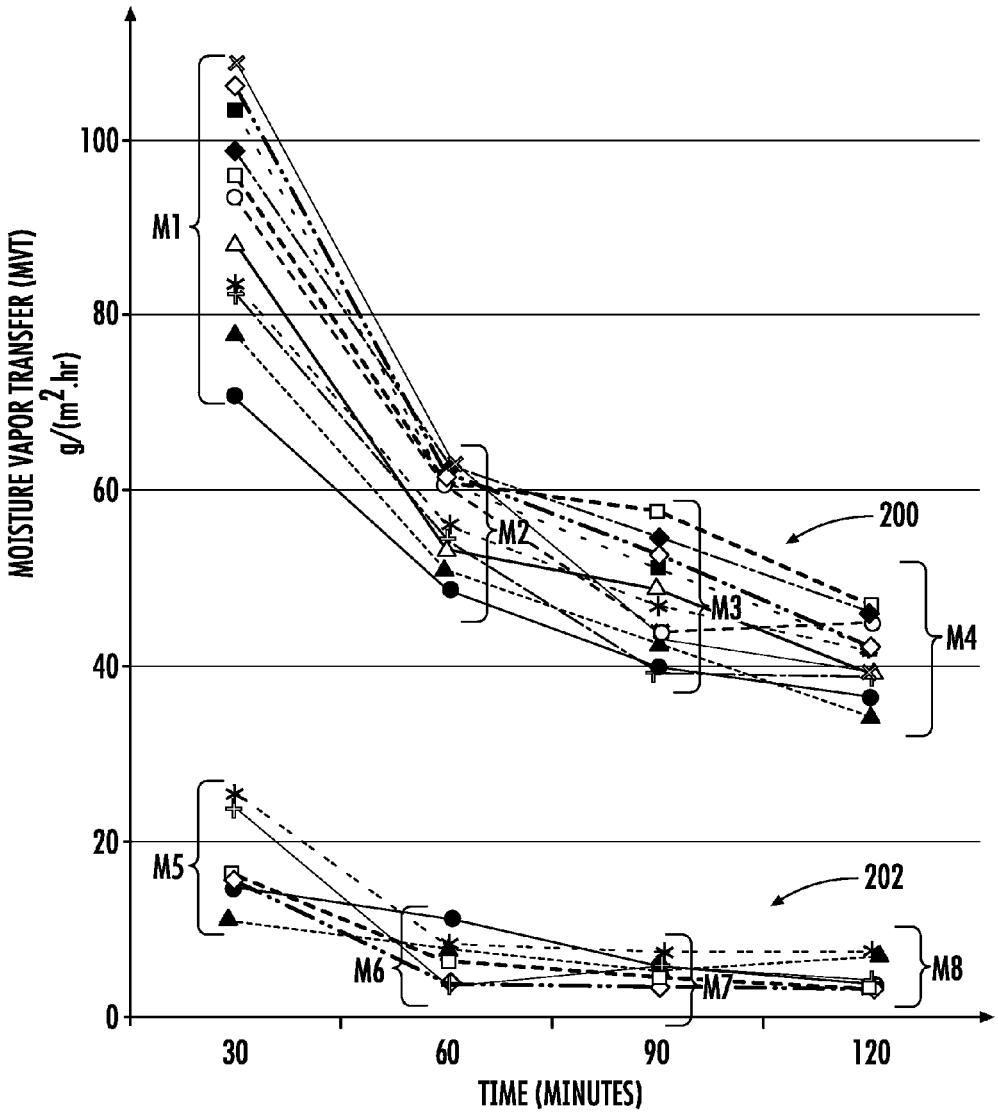
FIG. 15 is a graph representing test data for the moisture vapor transfer through several embodiments of the patient support of the present invention and of several prior art patient supports incorporating a coated nylon cover.

Referring to FIG. 15, moisture vapor transfer tests were performed using the test procedure described by Reger, Steven I., in Validation Test for Climate Control on Air-Loss Supports, Arch Phys. Med. Rehabil., May 2001, pp. 597-603, vol. 82. The tests were performed over a 2 hour period on several embodiments of the present invention, namely, non-powered patient supports with a bladder layer, a foam crib on top of the bladder layer, a 3D fabric layer on top of the foam crib, and a cover formed from GORE® Medical Fabric with moisture vapor transfer rates (MVTR) in a range of 3900=7000 g/m$^2$/24 hours and also on several prior art mattresses with conventional coated nylon covers. The tests were performed with a loading gauge, which was used to act as a torso of an average size male. Water was circulated to the loading gauge, which was placed on a dry moisture reservoir, and connected to a water bath to keep the interface at 37°+/−0.5° C. The loading gauge and support surface were adjusted 23 cm below the water bath level and the air flow through the interface was then initiated. After the dry moisture reservoir came to temperature equilibrium for 30 minutes, it was replaced with a wet one that was saturated with 36 g of saline. The saturated reservoir simulated the moisture and humidity from a human body lying on a support surface. The evaporation rate was recorded over a 120 minute test period.

The test results are shown in graphical form, which illustrate the differences in the performance curves 200, 202 of the respective patient supports, with curves 200 representing the test data for patient supports of the several embodiments of the present invention, and curves 202 representing the test data for prior art mattresses with coated nylon covers.

As best seen in FIG. 15, performance curves 200 have an initial moisture vapor transfer (MVT) (measured 30 minutes after the start of the test) M1, which is greater than 60 g/(m$^2$·hr), greater than 70 g/(m$^2$·hr), and falls in a range of approximately 70 to 105 g/(m$^2$·hr), which decays after approximately 30 minutes to a lower MVT M2 of greater than 40 g/(m$^2$·hr), greater than 45 g/(m$^2$·hr), and in a range of approximately 50 to 65 g/(m$^2$·hr) and decays to a second lower MVT M3 greater than 35 g/(m$^2$·hr) and of at least 40 g/(m$^2$·hr), and in a range of 40 to 55 g/(m$^2$·hr) after another 30 minutes. After another 30 minute period, the MVT then decays to a fourth, and in some cases steady state, MVT M4 greater than 20 g/(m$^2$·hr), at least 30 g/(m$^2$·hr) and in a range of approximately 30 to 48 g/(m$^2$·hr).

In contrast, the initial MVT M5 (after 30 minutes) of the prior art mattresses with nylon covers falls in a range of approximately 24 g/(m$^2$·hr) to 10 g/(m$^2$·hr), which after 30 minutes decays to a MVTM6 in a range of 11 g/(m$^2$·hr) to 4 g/(m$^2$·hr), and decays to a steady state MVT M7 in a range of 8 g/(m$^2$·hr) to 4 g/(m$^2$·hr), which remain generally constant so that the MVT M7 values are approximate equal to the MVT M8 values measured after 2 hours after the start of the test.

Consequently, it can be seen that a patient support of the present invention exhibits a significantly improved moisture vapor management system (in the absence of power) over prior art mattresses by providing a greatly increased initial MVT, which decays to MVT that also far exceeds not only the steady state MVT of a conventional mattress with a coated nylon cover but also exceeds their initial maximum MVT.

While several forms of the invention have been shown and described, other changes and modifications will be appreciated by those skilled in the relevant art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which we claim an exclusive property right or privilege are defined as follows:

1. A patient support comprising:

an air flow system for directing air flow into the patient support;

a bladder layer formed from an upper sheet and a lower sheet joined together to form a plurality of fluid pressurized bladders, each bladder having an internal chamber and an upwardly facing surface for facing and supporting a patient, said bladders having a network of fluid passageways between the bladders to redistribute pressure between surrounding bladders, the network of fluid passageways being adapted to maintain the fluid in the chambers at a minimum pressure and release fluid from the chambers when the collective pressure in the chambers exceeds a maximum pressure, and the network further being adapted to redistribute fluid pressure between the chambers so that when one or more of the bladders are compressed by a part of a patient's body, the increase in pressure in the fluid in the compressed bladder or bladders will be redistributed to the chambers surrounding the compressed bladder or bladders and to redistribute the increase in pressure in the surrounding bladders to their surrounding bladders so that the bladders that surround the compressed bladder or bladders will allow the patient to immerse into the bladder layer and envelope that part of the patient's body to thereby distribute the weight of that part of the patient's body over a greater contact area than just the facing surface of the bladder or bladders that are compressed by that part of the body;

said bladder layer configured to allow air flow to flow from the air flow system through at least one of said sheets forming said fluid pressurized bladders external to said chambers to facilitate moisture management; and a cover over the fluid pressurized bladders, the cover having an upwardly facing patient surface and a bladder layer facing surface, the upwardly facing patient surface for forming a patient support surface on the support and forming a patient interface, and the bladder layer facing surface lying on the upwardly facing surfaces of the bladders wherein the cover and the bladder layer are free of any intermediate cushioning layer, and the cover comprising a moisture vapor permeable, but generally liquid impermeable cover to allow moisture vapor flow through the cover into a space beneath said cover and either in the bladder layer or above the bladder layer, wherein the bladder layer forms a reservoir for the moisture vapor passing through the cover, and the air flow from the air flow system directing moisture vapor to flow out of the cover at a location other than the interface so that together the cover and the bladder layer will transport away moisture from the patient's body at the interface.

2. The patient support according to claim 1, wherein each of the chambers is in fluid communication with its adjacent chambers via conduits, and the conduits forming the network of fluid flow passageways between the bladders.

3. The patient support according to claim 1, wherein each respective bladder in at least a group of the bladders has a resilient body in its respective chamber to reform the shape of the respective bladder when a compression load on the respective bladder is removed, the resilient bodies comprising foam blocks.

4. The patient support according to claim 1, wherein the upper sheet comprises an impermeable material.

5. The patient support according to claim 1, wherein the upper sheet is impermeable.

6. The patient support according to claim 1, wherein the chambers are arranged in a plurality of rows extending laterally across the support, with each of the rows having at least two of the chambers.

7. The patient support according to claim 1, wherein each upper facing surface has a rectangular perimeter.

8. A patient support comprising:

an air flow system for directing air flow into the patient support;

a bladder layer formed from an upper sheet and a lower sheet joined together to form a plurality of fluid pressurized bladders, each bladder having an internal chamber and an upwardly facing surface for facing and supporting a patient, said layer configured to allow air flow to flow from the air flow system through at least one of said sheets forming said fluid pressurized bladders external to said chambers to facilitate moisture management; and a cover over the fluid pressurized bladders, the cover having an upwardly facing patient surface and a bladder layer facing surface, the upwardly facing patient surface for forming a patient support surface on the support and forming a patient interface, and the bladder layer facing surface lying on the upwardly facing surfaces of the bladders wherein the cover and the bladder layer are free of any intermediate cushioning layer, and the cover comprising a moisture vapor permeable, but generally liquid impermeable cover to allow moisture vapor flow through the cover into a space beneath said cover and either in the bladder layer or above the bladder layer, wherein the bladder layer forms a reservoir for the moisture vapor passing through the cover, and the air flow from the air flow system directing moisture vapor flow out of the cover at a location other than the interface so that together the cover and the bladder layer will transport away moisture from the patient's body at the interface, wherein each of the chambers is in fluid communication with its adjacent chambers via conduits, and the conduits forming a network of fluid flow passageways between the bladders, the network of fluid passageways being adapted to maintain the fluid in the chambers at a minimum pressure and release fluid from the chambers when the collective pressure in the chambers exceeds a maximum pressure, and the network further being adapted to redistribute fluid pressure between the chambers so that when one or more of the bladders are compressed by a part of a patient's body, the increase in pressure in the fluid in the compressed bladder or bladders will be redistributed to the chambers surrounding the compressed bladder or bladders and to redistribute the increase in pressure in the surrounding bladders to their surrounding bladders so that the bladders that surround the compressed bladder or bladders will allow the patient to immerse into the bladder layer and envelope that part of the patient's body to thereby distribute the weight of that part of the patient's body over a greater contact area than just the facing surface of the bladder or bladders that are compressed by that part of the body.

9. The patient support according to claim 8, wherein the network of fluid passageways are formed between the upper sheet and the lower sheet.

10. The patient support according to claim 9, wherein the network of fluid passageways is formed by tubing between the upper sheet and the lower sheet.

11. The patient support according to claim 9, further comprising a pressure relief valve in fluid communication with the network of fluid passageways, wherein when the pressure in the chambers with resilient bodies exceeds the maximum pressure, the pressure relief valve will allow fluid to discharge from the network of fluid passageways.

12. The patient support according to claim 11, further comprising a check valve in fluid communication with the network of fluid passageways, wherein when the pressure in the chambers falls below the minimum pressure, the check valve will allow fluid to flow into the network of fluid passageways.

13. A patient support comprising:

a cushioning layer formed from a plurality of discrete, spaced cushioning elements, each cushion element comprising a chamber and having an upwardly facing surface for facing and supporting a patient, said cushioning layer having a network of fluid passageways between said chambers to allow pressure redistribution between surrounding chambers, the network of fluid passageways being adapted to maintain the fluid in the chambers at a minimum pressure and release fluid from the chambers when the collective pressure in the chambers exceeds a maximum pressure, and the network further being adapted to redistribute fluid pressure between the chambers so that when one or more of the cushioning elements are compressed by a part of a patient's body, the increase in pressure in the fluid in the compressed cushioning element or cushioning elements will be redistributed to the chambers surrounding the compressed cushioning element or cushioning elements and to redistribute the increase in pressure in the surrounding cushioning elements to their surrounding cushioning elements so that the cushioning elements that surround the compressed cushioning element or cushioning elements will allow the patient to immerse into the cushioning layer and envelope that part of the patient's body to thereby distribute the weight of that part of the patient's body over a greater contact area than just the facing surface of the cushioning element or cushioning elements that are compressed by that part of the body;

said cushioning layer configured to allow air flow to flow there through to facilitate moisture management; and a cover over the cushioning layer, the cover having an upwardly facing patient surface and a cushioning layer facing surface, the upwardly facing patient surface for forming a patient interface, the cushioning layer facing surface lying on the upwardly facing surfaces of the cushioning elements wherein the cover and the cushioning elements are free of any intermediate cushioning layer there between, and the cover comprising a moisture vapor permeable, but generally liquid impermeable cover to allow moisture vapor flow through the cover into a space beneath the cover and either in the cushioning layer or above the cushioning layer, wherein the cushioning layer forms a reservoir for the moisture vapor passing through the cover, and the air flow directing moisture vapor flow out of the cover at a location other than the interface so that together the cover and the cushioning layer will transport away moisture from the patient's body at the interface.

14. The patient support according to claim 13, wherein the cushioning layer comprises a gel layer.

15. The patient support according to claim 13, wherein each of the cushioning elements comprises a bladder, each bladder forming a respective chamber of said chambers.

16. The patient support according to claim 15, wherein the bladders are arranged in a plurality of rows extending laterally across the patient support, with each of the rows having a plurality of bladders, and the bladders being in fluid communication with each other to form a network of bladders.

17. The patient support according to claim 13, wherein the cushioning layer is formed by an upper sheet joined with a lower sheet, said chambers formed between the upper sheet and the lower sheet.

18. The patient support according to claim 17, wherein the upper sheet is impermeable.

19. The patient support according to claim 17, wherein the network of fluid passageways are formed between the upper sheet and the lower sheet.

20. The patient support according to claim 13, wherein each upwardly facing surface of said cushioning elements has a rectangular perimeter.

* * * * *

UNITED STATES PATENT AND TRADEMARK OFFICE

CERTIFICATE OF CORRECTION

PATENT NO. : 8,910,334 B2
APPLICATION NO. : 12/640770
DATED : December 16, 2014
INVENTOR(S) : Patrick Lafleche et al.

It is certified that error appears in the above-identified patent and that said Letters Patent is hereby corrected as shown below:

IN THE CLAIMS

Col. 18, Claim 13, Line 61:

The word "cushion" should be "cushioning".

Signed and Sealed this
First Day of March, 2016

Michelle K. Lee

Michelle K. Lee
*Director of the United States Patent and Trademark Office*